US008300769B2

(12) United States Patent
Kim et al.

(10) Patent No.: US 8,300,769 B2
(45) Date of Patent: Oct. 30, 2012

(54) MICROMINIATURE X-RAY TUBE WITH TRIODE STRUCTURE USING A NANO EMITTER

(75) Inventors: Dae Jun Kim, Daejeon (KR); Yoon Ho Song, Daejeon (KR); Jin Woo Jeong, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 269 days.

(21) Appl. No.: 12/743,496

(22) PCT Filed: Nov. 13, 2008

(86) PCT No.: PCT/KR2008/006683

§ 371 (c)(1), (2), (4) Date: May 18, 2010

(87) PCT Pub. No.: WO2009/078581

PCT Pub. Date: Jun. 25, 2009

(65) Prior Publication Data

US 2011/0116603 A1 May 19, 2011

(30) Foreign Application Priority Data

Dec. 17, 2007 (KR) ..... 10-2007-0132552

(51) Int. Cl.
*H01J 35/00* (2006.01)

(52) U.S. Cl. ..... 378/122; 378/138

(58) Field of Classification Search ..... 378/119, 378/121, 122, 136, 138

See application file for complete search history.

(56) References Cited

FOREIGN PATENT DOCUMENTS

| | | | |
|---|---|---|---|
| JP | 2000-348647 | A | 12/2000 |
| KR | 2007-0039257 | A | 4/2007 |
| KR | 2007-0060834 | A | 6/2007 |
| KR | 2007-0071900 | A | 7/2007 |
| KR | 2007-0071918 | A | 7/2007 |

*Primary Examiner* — Jurie Yun
(74) *Attorney, Agent, or Firm* — Rabin & Berdo, P.C.

(57) ABSTRACT

A microminiature X-ray tube with a triode structure using a nano emitter is provided, which can increase a field emission region as much as possible by means of nano emitters fine-patterned in a cathode to not only increase an emission current per unit area as much as possible but secure high electrical characteristics, reliability, and structural stability by means of a cover and a bonding material. In addition, gate holes having a macro structure can be formed in the gate to promote electron beam focusing by means of the gate without using a separate focusing electrode and to prevent a leakage current from occurring on the gate. Further, an auxiliary electrode can be formed on a top or an inner surface of a cover applied for structural stability to further promote the electron beam focusing and to control the output amounts per individual X-ray tubes output.

15 Claims, 9 Drawing Sheets

MICROMINIATURE X-RAY TUBE WITH TRIODE STRUCTURE USING A NANO EMITTER

TECHNICAL FIELD

The present invention relates to a microminiature X-ray tube with a triode structure using a nano emitter such as carbon nano tube (CNT), and more particularly, to a microminiature X-ray tube with a triode structure which uses the nano emitter to secure high electrical characteristics, reliability, and structural stability.

BACKGROUND ART

X-ray tubes are typically employed as X-ray sources for medical apparatuses, industrial measuring apparatuses and so forth, and have recently been employed as X-ray fluorescences (XRFs) and X-ray sources of electrostatic neutralization apparatuses, use of which has largely increased.

A typical X-ray tube includes a ceramic stem (also referred to as a vacuum tube) with cathode pins vertically disposed and an output window with a target metal deposited on its bottom surface, which are supported by ceramic valves and soldered to each other, and focusing electrodes are disposed along an inner circumferential surface of the ceramic valve simultaneously while lower portions of the focusing electrodes are fitted with the ceramic stem by means of valves. That is, the ceramic components are used at two points, and thus the components must be handled with care. In addition, it is difficult to manufacture the X-ray tube at a low cost. Both the stem and the output window need to be soldered, and thus manufacture thereof is very time-consuming. In addition, the X-ray tube usually requires different soldering materials for both the stem and the output window so that the operation process becomes complicated, which makes mass production difficult. In addition, a process of soldering the output window and the ceramic valve is carried out after a process of mounting a tungsten coil (i.e., a cathode filament) on the cathode pins. Accordingly, the tungsten coil and the cathode pins where the tungsten coil is fixed are exposed to a high temperature and the fixing portion for the tungsten coil and the cathode pins is heated. As a result, the fixing portion between the tungsten coil and the cathode pins becomes loose, which leads to deterioration of properties and lifetime of the filament so that the reliability may be lost.

Meanwhile, a conventional thermionic emission X-ray tube using filaments usually employs a diode structure of a cathode and an anode. To detail this, it employs a technique of applying a high voltage to the anode to accelerate electrons when the electrons are emitted from the cathode, which thus makes it difficult to focus and control the electrons. Further, since the thermionic emission from the filament is omnidirectional, the efficiency with regard to an amount of electrons actually reaching the anode becomes extremely low.

To cope with such a problem, one of the materials recently in the limelight is a nano emitter. The nano emitter acts as an emitter using a field emission principle that electrons are emitted when an electric field is applied to a pointed conductive emitter in a vacuum state, and provides the most superior performance and very high efficiency since it has unidirectional linearity of electron emission.

FIGS. 1A and 1B illustrate a conventional X-ray tube using nano emitters. FIG. 1A illustrates a transmissive type structure and FIG. 1B illustrates a reflective type structure.

Referring to FIGS. 1A and 1B, according to the conventional X-ray tube using nano emitters, when electrons are emitted from nano emitters 110 formed in a cathode 120 according to the electron emission induction of a gate 130, the emitted electrons are focused onto anodes 140*a* and 140*b* by focusing electrodes E, which then collide with the transmissive type anode 140*a* or the reflective type anode 140*b* to generate an X-ray (L). That is, the gate 130 for inducing the electron emission is disposed between the transmissive type anode 140*a* and the cathode 120 or between the reflective type anode 140*b* and the cathode 120, and thus the triode structure is implemented.

However, according to the conventional X-ray tube using nano emitters, focusing the electron beams is adjusted by the voltage to be applied to the focusing electrodes E, so that another separate focusing electrode E must be disposed when the electron beam focusing needs to be implemented or enhanced, which thus results in a complicated structure and a difficult manufacturing process.

Further, when the electrons $B_{leak}$ emitted from nano emitters 110 are leaked to the gate 130, the gate 130 is deformed due to thermal deformation or the like resulting from the leakage current so that the reliability of the electron emission is lowered, which must also be necessarily overcome.

In a case of the XRF, when a high voltage of about 40 kV is applied to the anodes 140*a* and 140*b* for accelerating electrons, the structure may be damaged due to undesired arcing or the like, which must also be overcome.

DISCLOSURE OF INVENTION

Technical Problem

The present invention is directed to a microminiature X-ray tube with a triode structure using a nano emitter for increasing an emission current per unit area, which is emitted from the nano emitters fine-patterned in the cathode, as much as possible.

The present invention is also directed to a microminiature X-ray tube with a triode structure using a nano emitter for securing high electrical characteristics, reliability, and structural stability of the X-ray tube using the nano emitter.

The present invention is also directed to a microminiature X-ray tube with a triode structure using a nano emitter for promoting electron beam focusing a gate without a separate focusing electrode and preventing a leakage current from occurring on the gate in the X-ray tube using the nano emitter.

The present invention is also directed to a microminiature X-ray tube with a triode structure using a nano emitter for forming an additional auxiliary electrode on a cover applied for structural stability to further enhance electron beam focusing in addition to the electron beam focusing a gate.

The present invention is also directed to a microminiature X-ray tube with a triode structure using a nano emitter for controlling an output amount per each X-ray tube to be the same amount which is output from the X-ray tube using the nano emitter according to current switching.

Technical Solution

One aspect of the present invention provides a microminiature X-ray tube with a triode structure using a nano emitter including: a cathode having fine-patterned nano emitters; a gate disposed above the cathode to induce electron emission and focus electron beams; an electron emitter including a cover disposed above the gate; and an anode disposed above the electron emitter and accelerating electrons emitted from the cathode to generate an X-ray by means of electron collision, wherein the electron emitter is fixed from the cathode to the cover by a bonding material.

In this case, the cover may have a hole larger than a field emission region of the nano emitters.

A plurality of gate holes each having the same pitch as the nano emitters may be formed in a macro structure in the gate, and sizes of the gate holes may be greater than sizes of the nano emitters. In particular, the gate holes may have an inclined opening structure which is inclined at a predetermined angle to allow the electron beams emitted from the nano emitters to be focused onto the anode.

In addition, the gate and the cover may be formed of a metal material having a thermal expansion coefficient similar to the bonding material.

In addition, an auxiliary electrode formed of a conductive metal may be disposed on a top or an inner surface of the cover to allow the electron beams focused through the gate to have a finer focal point.

In addition, the electron emitter may further include a transistor for current switching, wherein the cathode is coupled to a source of the transistor, a pulse voltage is applied to the gate of the transistor, and an amount of electrons emitted from the nano emitters is changed according to the pulse voltage applied to the gate of the transistor.

Advantageous Effects

As described above, a microminiature X-ray tube with a triode structure using a nano emitter according to the present invention has the following advantages:

First, a field emission region can be increased as much as possible by nano emitters fine-patterned in a cathode so that an emission current per unit area can be increased as much as possible, and high electrical characteristics, reliability, and structural stability can be secured by a cover and a bonding material.

Second, gate holes having a macro structure can be formed in a gate so that electron beams can be focused by the gate without a separate focusing electrode and a leakage current can be prevented from occurring on the gate.

Third, an auxiliary electrode can be formed on a top or an inner surface of the cover applied for structural stability to additionally promote the electron beam focusing.

Fourth, the present invention can be directly applied to existing X-ray tubes which are currently available without separately changing the structures, so that it is cost-effective.

Fifth, since an output amount per each X-ray tube which is output according to current switching can be controlled to be the same amount, the lifetime of the X-ray tube can be lengthened.

DESCRIPTION OF MAJOR SYMBOLS IN THE ABOVE FIGURES

Figure 1A:
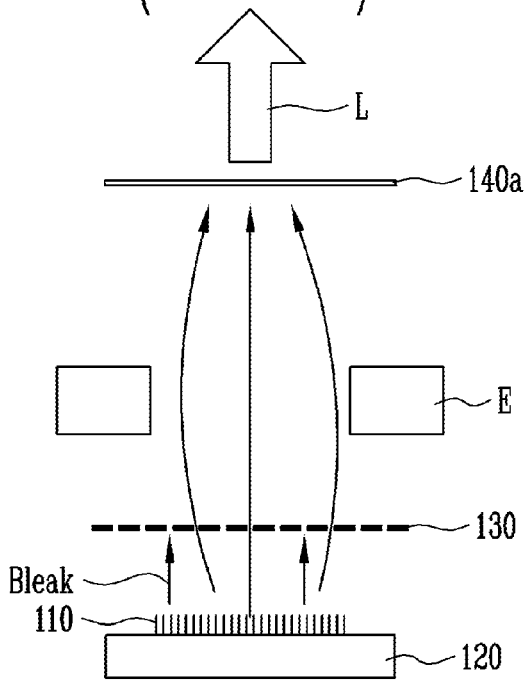
FIG. 1A (PRIOR ART)
FIGS. 1A and 1B illustrate a conventional X-ray tube using nano emitters.

200: electron emitter
210: nano emitters
220: cathode
230: spacer
240: gate holes
250: gate
260: cover
270: bonding material
300, 300*a*, 300*b*: anode Mode for the Invention Hereinafter, exemplary embodiments of the present invention will be described in detail with respect to the microminiature X-ray tube with a triode structure using the nano emitter. However, the present invention is not limited to the exemplary embodiments disclosed below, but can be implemented in various types. Therefore, the present exemplary embodiments are provided for complete disclosure of the present invention and to fully inform the scope of the present invention to those ordinarily skilled in the art.

Figure 2:
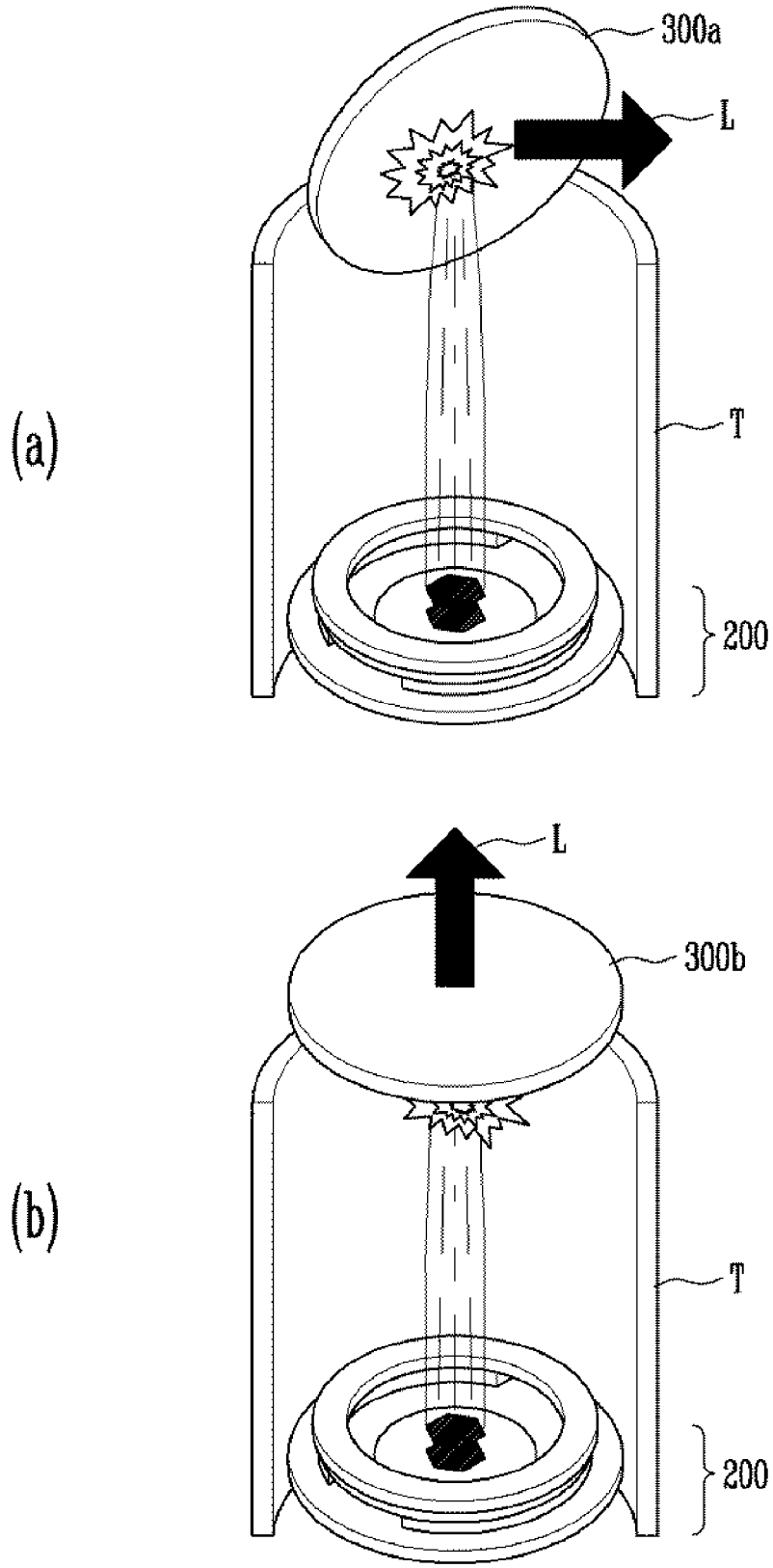
FIGS. 2A and 2B schematically illustrate a microminiature X-ray tube with a triode structure using a nano emitter according to an exemplary embodiment of the present invention.

FIGS. 2A and 2B schematically illustrate a microminiature X-ray tube with a triode structure using a nano emitter according to an exemplary embodiment of the present invention. FIG. 2A illustrates a reflective type structure and FIG. 2B illustrates a transmissive type structure.

Referring to FIGS. 2A and 2B, in the microminiature X-ray tube with a triode structure using a nano emitter according to an exemplary embodiment of the present invention, when electrons are emitted from an electron emitter 200 within a vacuum tube T, the emitted electrons are focused onto a reflective type anode 300*a* or a transmissive type anode 300*b* and then collide with the reflective type anode 300*a* or the transmissive type anode 300*b*, thereby generating an X-ray (L).

Hereinafter, the electron emitter 200 will be described in more detail with reference to FIG. 3.

Figure 3:
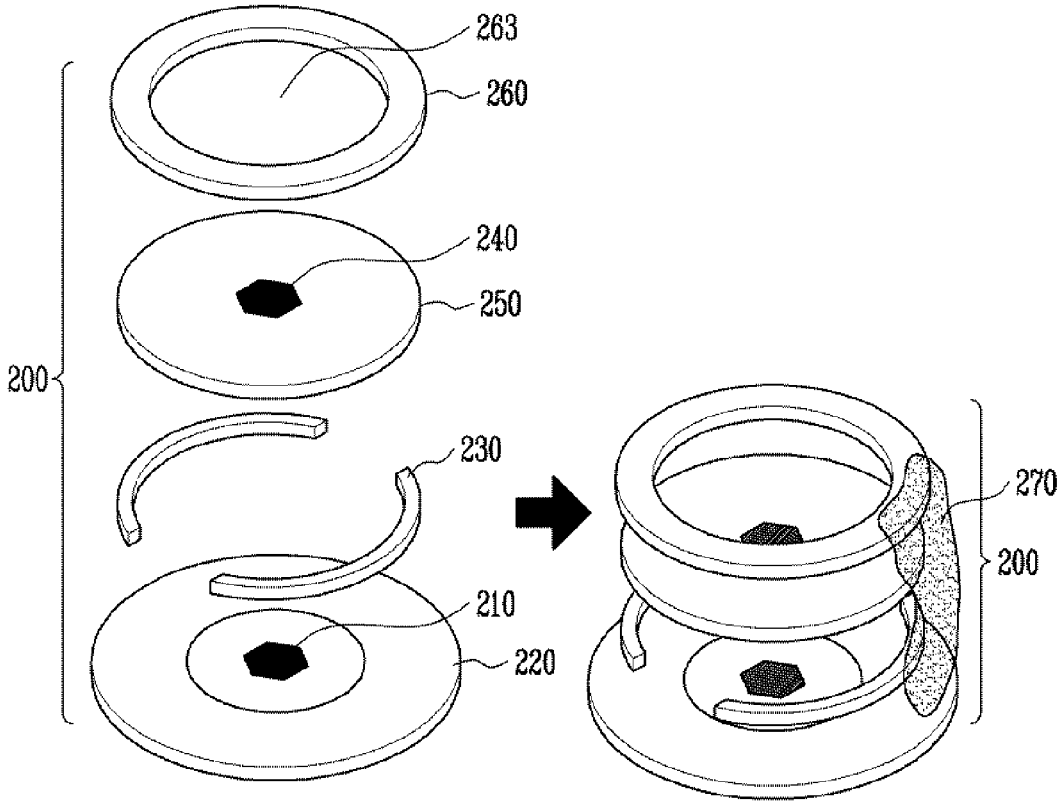
FIG. 3 illustrates an electron emitter shown in FIGS. 2A and 2B.

FIG. 3 illustrates the electron emitter 200 shown in FIGS. 2A and 2B.

Referring to FIG. 3, the electron emitter 200 of the present invention includes a cathode 220 on which nano emitters 210 are fine-patterned and emit electrons, a gate 250 for inducing the electron emission and having a plurality of gate holes 240 each having the same pitch as the nano emitters 210, a spacer 230 for maintaining a predetermined interval between the cathode 220 and the gate 250, and a cover 260 disposed on the gate 250.

In the present embodiment, a method of fine-patterning the nano emitters 210 on the cathode 220 may employ the following method.

CNT powders, organic binders, photosensitive materials, monomers, and nano-sized metal particles are first dispersed in a solvent to manufacture a CNT paste, which is then applied onto an electrode formed on a substrate. The CNT paste applied onto the electrode is then exposed to light to be fine-patterned, and the fine-patterned CNT paste is sintered to allow the surface of the CNT paste to be processed so as to activate the surface of the sintered CNT paste. In this case, it is preferable to pattern the substrate in advance so as to allow the fine-patterning to be implemented on the cathode 220 through exposure and development. Any shape of substrate, such as circular, may be applied for the cathode 220, and various materials, ranging from glass coated with Indium Tin Oxide (ITO) to metal, may be employed to form the substrate. In addition, when the CNT paste is exposed to light and fine-patterned, it is preferable to pattern the CNT paste with a fine size of at least 5 μm×5 μm which is the limit for maintaining the contact with the electrode. And the metal particles are added in a powder or paste form, and are formed of a high conductivity metal such as Ag, Cu, Ru, Ti, Pd, Zn, Fe, or Au.

Meanwhile, when the nano emitters 210 are fine-patterned on the cathode 220 by the method as described above, the spacer 230 and the gate 250 are sequentially disposed on the cathode 220.

In this case, the spacer 230 acting to maintain a predetermined interval between the spacer 220 and the gate 250, is preferably formed of an insulating material such as glass, ceramic and so forth which has a thickness of 10 μm to 1000 μm, and allows the cathode 220 and the gate 250 to be electrically insulated from each other.

The gate 250 is formed of a metal material and an insulating material deposited with a metal, and has the gate holes 240 having the same pitch as the nano emitters 210 at its center, which will be described later.

Meanwhile, a UV glue capable of being used in a vacuum state may be employed for fixing the structure of which the cathode 220, the spacer 230, and the gate 250 are sequentially arranged, however, a more improved structure is required to secure the structural stability in high voltage circumstances.

To this end, as shown in FIG. 3, after the cover 260 is disposed on the gate 250, the structure sequentially including the cathode 220, the spacer 230, the gate 250, and the cover 260 from bottom to top is hermetically bonded using a bonding material 270 such as a frit glass, so that the structure having a high fixation property may be implemented. At this time, the cover 260 is preferably formed of a metal material having a thermal expansion coefficient similar to the bonding material 270.

That is, the microminiature X-ray tube with the triode structure using the nano emitter according to an exemplary embodiment of the present invention may have the structural stability even in high voltage and high current circumstances by aid of the bonding as described above.

Meanwhile, the present invention enables the gate holes 240 of the gate 250 to have a macro structure, so that the emission current per unit area of the gate 250 may be increased as much as possible simultaneously while the leakage current is prevented from occurring on the gate 250 and focusing electron beam onto the anodes 300*a* and 300*b* is promoted, which will be described in more detail as follows.

Figure 4:
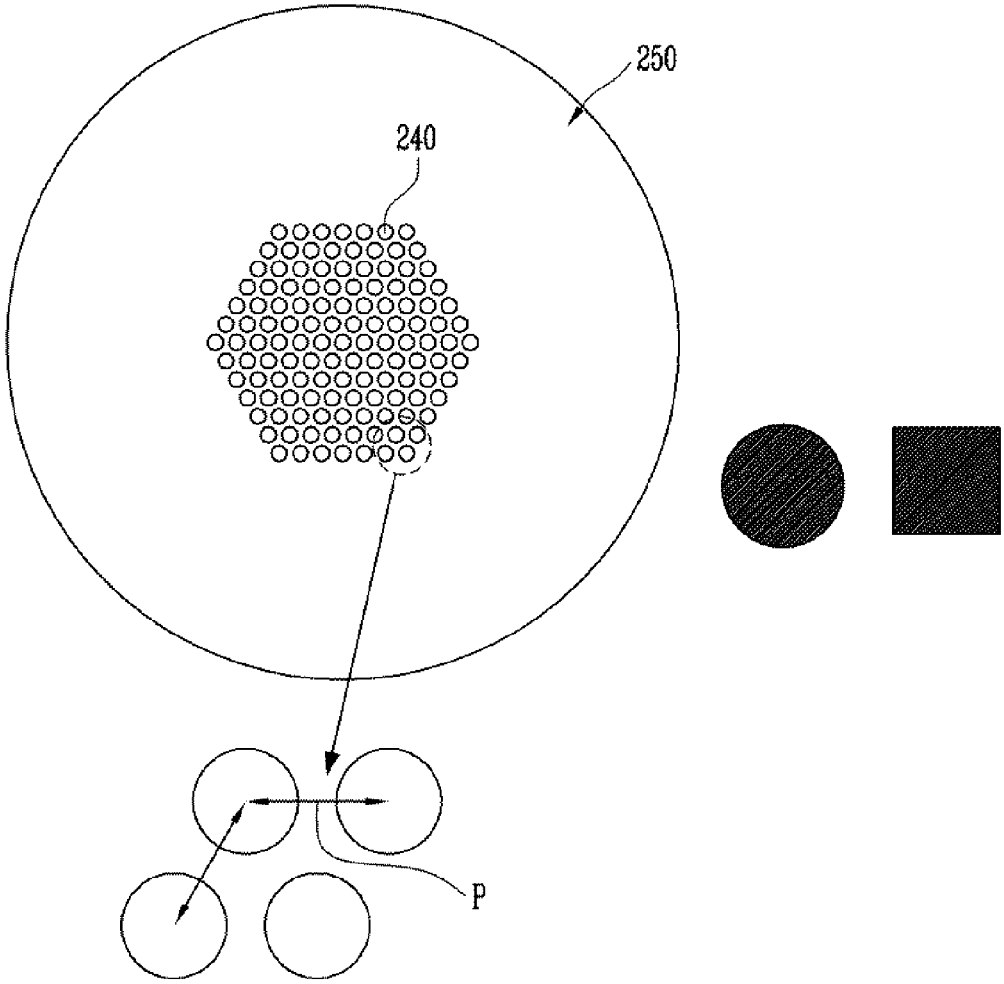
FIG. 4 illustrates gate holes of a gate shown in FIG. 3.
Figure 5A:
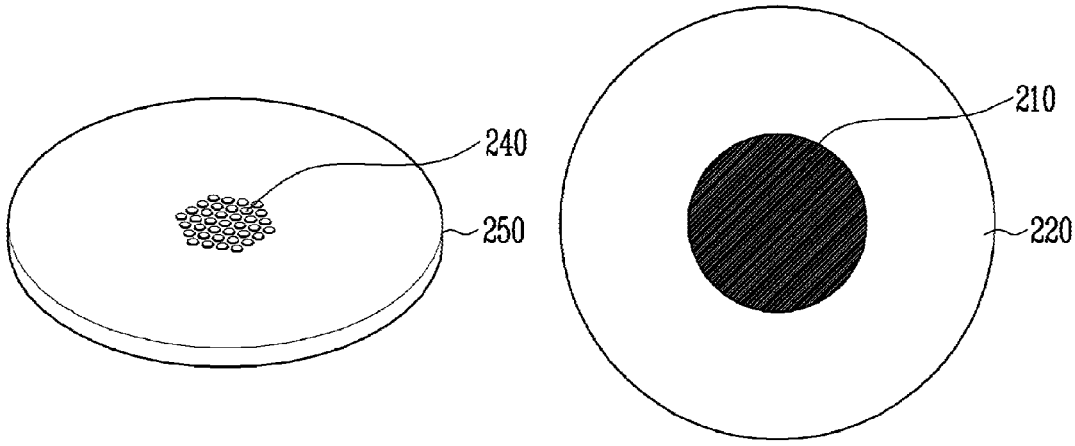
FIGS. 5A and 5B illustrate the structure in which nano emitters are aligned with the gate holes shown in FIG. 3.
Figure 5B:
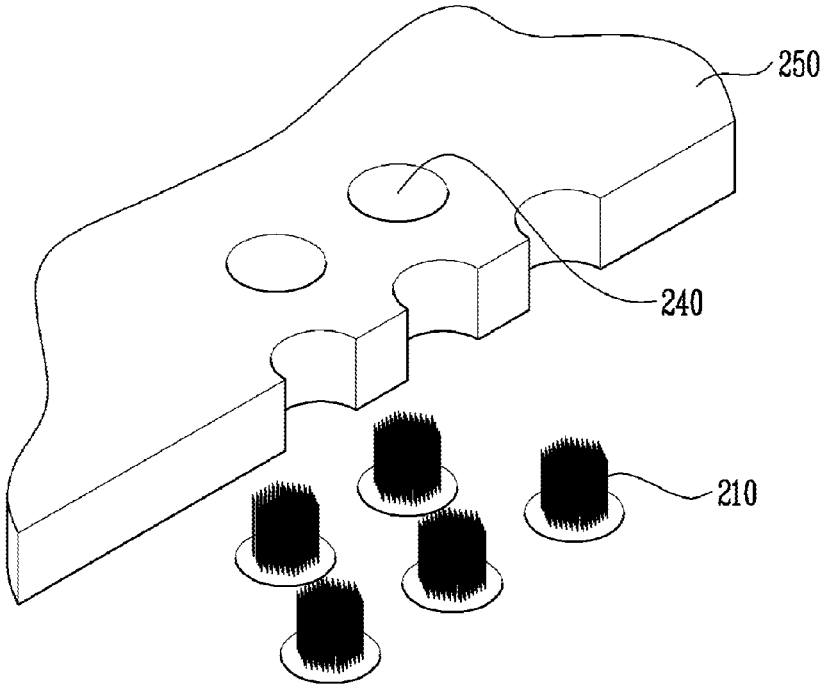

FIG. 4 illustrates the gate holes 240 of the gate 250 shown in FIG. 3, and FIGS. 5A and 5B illustrate the structure where the nano emitters 210 are aligned with the gate holes 240.

As shown in FIG. 4, a plurality of gate holes 240 are formed in the gate 250, and may have any shape such as circle or rectangle in addition to hexagon according to the shape of the vacuum tube T of the X-ray tube.

In this case, the gate 250 is preferably formed of a metal material (e.g., Kovar or the like when the cover is formed of glass) having a thermal expansion coefficient similar to the cover 260 and the bonding material 270. This is because the structural alignment may be fixed only when the thermal expansion characteristics are the same as each other while heat is applied for melting the bonding material 270 at the time of bonding. In addition, the thickness of the gate 250 may be selected in a range of 50 μm to 1000 μm according to the electron beam focusing.

The performance of the X-ray tube significantly depends on the electron emission induction performance of the gate 250. That is, the prerequisite for securing the performance of the X-ray tube is that the amount of emission electrons per unit area of the gate 250 must reach several tens of μA for example, up to several tens of mA.

To this end, as many gate holes 240 as possible must be formed within the size of the gate 250 while each gate hole has the minimum pitch P as shown in FIG. 4. At this time, the pitch P between the gate holes 240 may be changed depending on the metal, the required performance and the standard which are applied for the gate 250, however, is typically about 50 μm to about several thousand μm.

Meanwhile, as shown in FIGS. 5A and 5B, the gate holes 240 of the gate 250 are aligned with the nano emitters 210 formed in the cathode 220, however, heights and densities of the nano emitters 210 are not the same as each other when the nano emitters 210 are formed by screen printing, so that it is difficult to secure the uniformity of the electron beam emission when the conventional triode structure is employed.

To cope with this problem, according to the present invention, diameters of the gate holes 240 are formed to be two times the diameters of the nano emitters 210 in order to make the most of characteristics of the nano emitters 210 having heights and densities which are not uniform as shown in FIGS. 5A and 5B, so that the gate 250 has a macro structure.

In this case, the macro structure means a structure where the gate holes having a larger diameter than the nano emitters are formed at a much higher position than the nano emitters so as to allow almost all of the nano emitters to contribute to electron emission, which will be briefly described as follows for better understanding of the present invention.

The gate for inducing the electron beam in the typical triode structure is positioned at almost the same height as the nano emitters, and has a symmetric structure such that the nano emitters are positioned at the exact centers of the gate holes when seen in a plan view. Such a structure is usually referred to as a micro structure.

However, heights and densities of the nano emitters are not the same as each other, and thus it is difficult to secure the uniformity of the electron emission, which in turn makes a distance between the nano emitters and the gate holes shortened as much as possible to allow almost all of the nano emitters to contribute to the electron emission in the conventional micro structure.

However, in this case, the electron emission characteristic of the nano emitters is significantly changed according to the distance between the nano emitters and the gate holes, so that only the nano emitters close to the gate holes contribute to the electron emission and the nano emitters must be positioned at the exact center of the gate holes.

To cope with this problem, according to the present invention, the spacer 230 is disposed between the gate 250 and the cathode 220 with the fine-patterned nano emitters 210 such that the gate holes 240 are positioned much higher than the nano emitters 210 while the diameters of the gate holes 240 are formed to be about two times the diameters of the nano emitters 210 as shown in FIGS. 3, 5A and 5B.

As such, when the gate holes 240 are positioned to be much higher than the nano emitters 210, the region of the nano emitter appears to be one point when seen from the side of the gate holes 240, so that the distance between the gate holes 240 and each of the nano emitters 210 hardly has a difference.

Accordingly, the gate holes 240 are positioned much higher than the nano emitters 210, allowing almost all of the nano emitters 210 to contribute to electron emission, which is referred to as a macro structure.

Since the gate 250 of the present invention has gate holes 240 larger than the nano emitters 210 and performs the electron emission at a farther distance, more uniform electron beams are emitted from the fine-patterned nano emitters 210 within the gate holes 240. In addition, the nano emitters 210 are implemented to be smaller than the gate holes 240, the electrons emitted from the nano emitters 210 may be structurally prevented from leaking toward the gate 250.

Figure 1B:
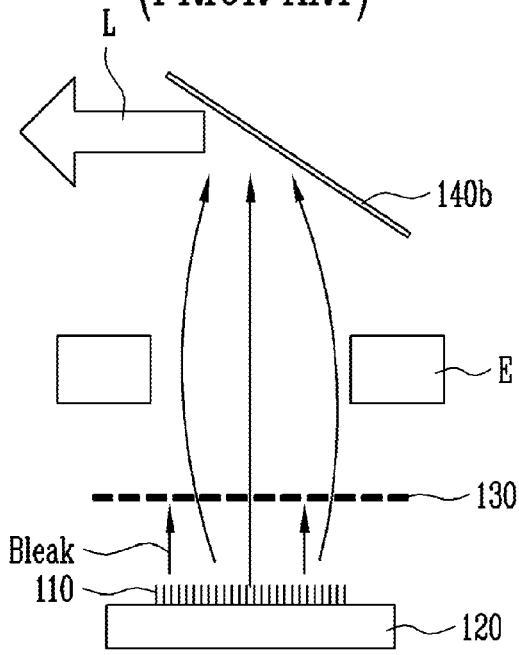
FIG. 1B (PRIOR ART)

Meanwhile, as described above, in a case of the X-ray tube with the triode structure using the conventional nano emitters as shown in FIGS. 1A and 1B, the focusing electrode E must be separately employed for focusing the emitted electrons onto the anodes 140*a* and 140*b*.

To cope with this problem, according to the present invention, the gate holes 240 of the gate 250 are formed to have inclined opening structures for focusing electron beams, so that the electron beams may be focused by the gate 250 only without requiring a separate focusing electrode, which will be described as follows in more detail.

Figure 6:
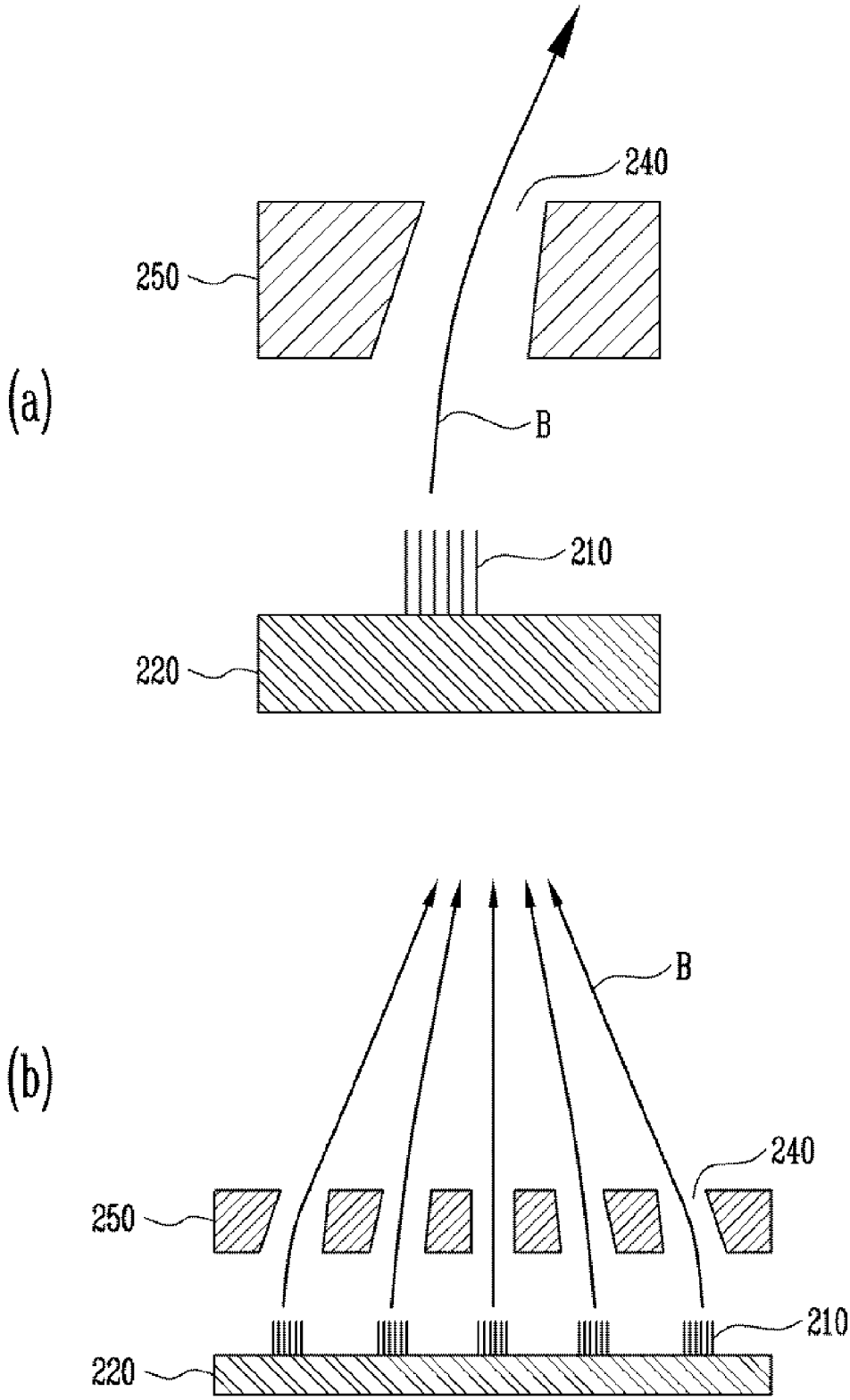
FIGS. 6A and 6B illustrate the inclined opening structure of the gate holes of the gate shown in FIG. 3.

FIGS. 6A and 6B illustrate inclined opening structures of the gate holes 240 of the gate 250 shown in FIG. 3.

As shown in FIG. 6A, the gate holes 240 formed in the gate 250 of the present invention have inclined opening structures which are inclined at a predetermined angle. Accordingly, it becomes possible to control the locus of the electron beam B emitted from the nano emitters 210 in any direction as shown in FIG. 6B, so that the electron beam focusing performance may be enhanced. This comes from the principle that an electric field distribution necessary for electron emission applied to the gate 250 is bent depending on the opening shape of the gate holes 240 so that the electron beam B is simultaneously subjected to the same effect.

Meanwhile, an auxiliary electrode is additionally formed on the cover 260 fixed on the gate 250 to further enhance the electron beam focusing according to the present invention, which will be described as follows in more detail.

Figure 7:
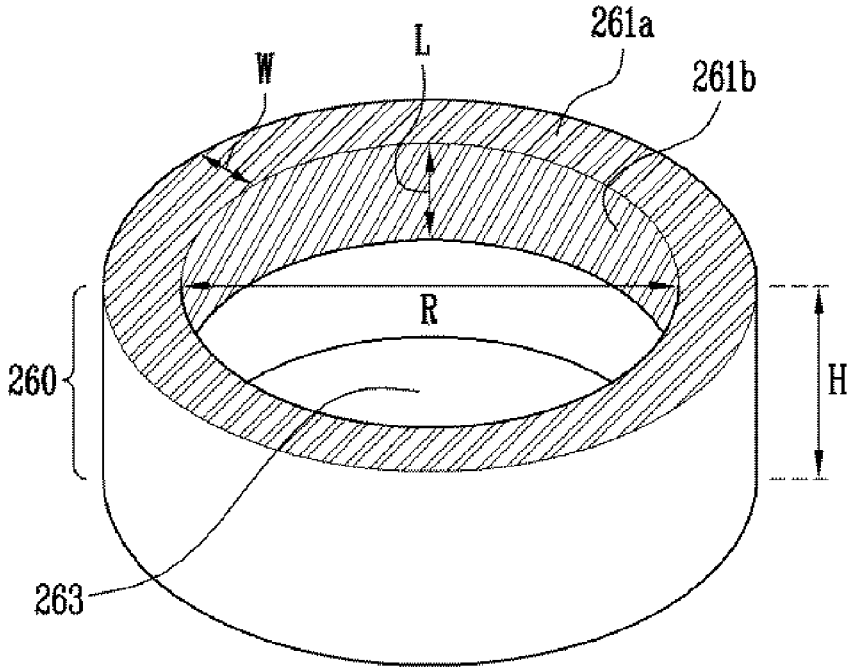
FIG. 7 illustrates the cover shown in FIG. 3.

FIG. 7 illustrates the cover 260 shown in FIG. 3.

As shown in FIG. 7, auxiliary electrodes 261*a* and 261*b* are formed on the top and the inner surface of the cover 260, respectively. The auxiliary electrodes 261*a* and 261*b* focus electron beams which were focused and output from the gate 250 to have a finer focal point. In this case, the auxiliary electrodes 261*a* and 261*b* are preferably formed of a conductive metal such as Cr or Al.

The thickness H of the cover 260 may be varied in a range of about 100 μm to about 10 cm depending on the focusing function and the structure, and an inner diameter R of the hole 263 is preferably larger than the electron emission region. It is preferable that the width W of the top auxiliary electrode 261*a* is not greater than the top width of the cover 260, and the length L of the internal auxiliary electrode 261*b* is not greater than one half of the thickness H of the cover 260 or has a value corresponding to a depth enough to secure the insulating property.

Figure 8:
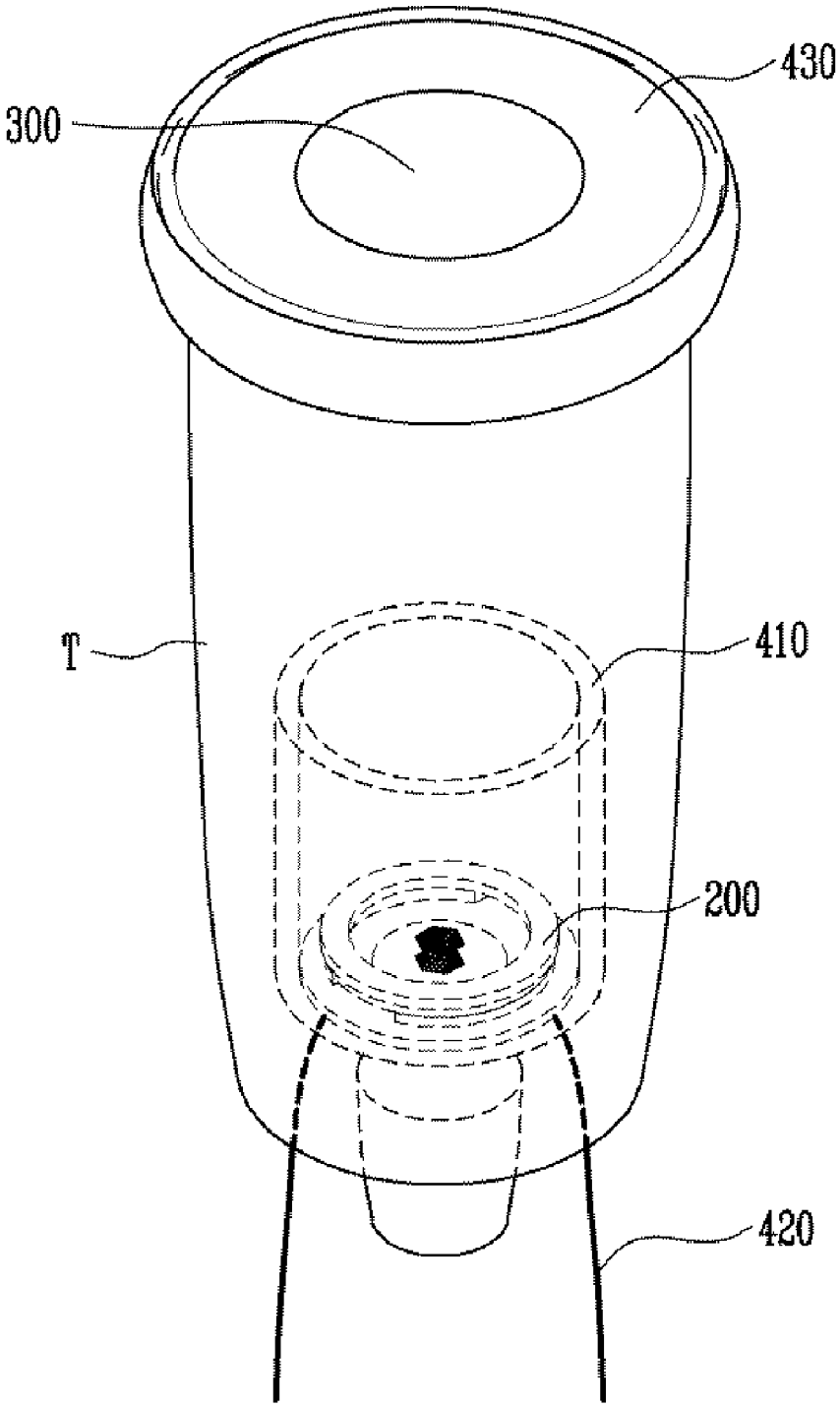
FIG. 8 illustrates the XRF to which a microminiature X-ray tube with a triode structure according to an exemplary embodiment of the present invention is applied.

FIG. 8 illustrates the XRF to which the microminiature X-ray tube with the triode structure according to an exemplary embodiment of the present invention is applied.

Referring to FIG. 8, the electron emitter 200 of the present invention may be easily mounted within the vacuum tube T, and is fixed to the vacuum tube T by the fixation portion 410.

An anode 300 is disposed on the vacuum tube T for accelerating emitted electrons to generate the X-ray by aid of electron collision. In addition, two to four lead wires 420 for applying a voltage are disposed on the electron emitter 200.

The dimension of the vacuum tube T has a length of 5 cm and an inner diameter of 1 cm in a case of the XRF structure, which may be freely changed according to the corresponding applications and structures.

The anode 300 is usually formed of a thin film such as beryllium, and has a support member 430 for supporting the anode 300 and securing the structural stability of the vacuum tube T.

A basic structure of the X-ray tube is already well known in the art. However, in a case of the reflective type structure, the metal target of the anode 300 is formed as shown in FIG. 2A.

Meanwhile, in a case of the X-ray tubes well known in the art, there were lifetime problems and the amount of X-rays and the electron beams output were not equal to each other per each X-ray tube regardless of the thermionic electron emission or cold electron emission of the X-ray tube.

To cope with these problems, according to the present invention, a transistor is coupled to the electron emitter 200 to allow current switching to be implemented to lengthen the lifetime of the X-ray tube and make the output amounts of individual X-ray tubes equal to each other, which will be described as follows in more detail.

Figure 9:
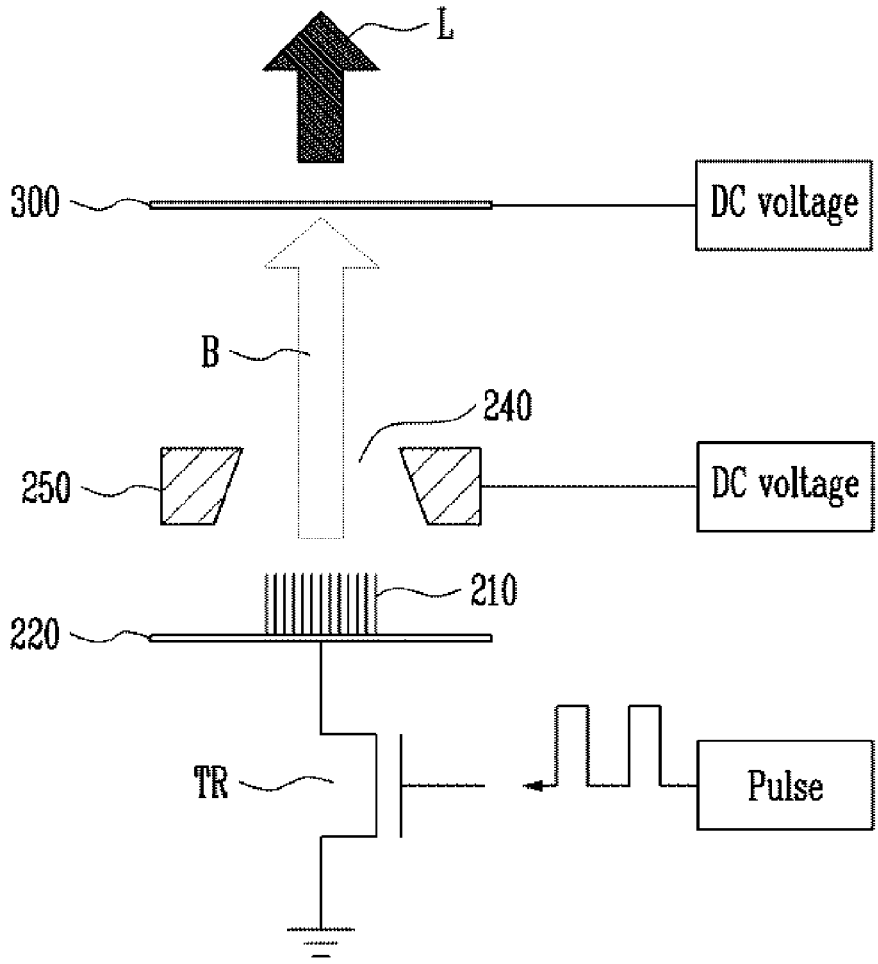
FIG. 9 schematically illustrates a transmissive type X-ray tube allowing current switching to be implemented according to an exemplary embodiment of the present invention.

FIG. 9 schematically illustrates the transmissive type X-ray tube allowing current switching to be implemented according to an exemplary embodiment of the present invention.

Referring to FIG. 9, the cathode 220 with the fine-patterned nano emitters 210 is coupled to the source of the transistor TR, a pulse voltage is applied to the gate of the transistor TR, and a ground is coupled to the drain of the transistor TR.

When electrons are emitted from the nano emitters 210 on the cathode 220 while the DC voltage is applied to the anode 300 and the gate 250, the emitted electrons are focused onto the anode 300 through the gate holes 240 of the gate 250, which are then collided with the anode 300 to generate the X-ray (L). At this time, the amount of electrons emitted from the nano emitters 210 on cathode 220 may be controlled by the pulse voltage applied to the gate of the transistor TR.

That is, when the pulse voltage is applied to the gate of the transistor TR, the amount of current emitted from the nano emitters 210 on the cathode 220 is controlled by the cathode current, which is controlled by the applied pulse voltage. Therefore, the output amounts of the individual X-ray tubes may be made to be equal to each other according to the pulse voltage applied to the gate of the transistor TR, and the lifetime of the X-ray tube may be lengthened.

While the invention has been shown and described with reference to certain exemplary embodiments thereof, it will be understood by those skilled in the art that various changes in form and details may be made therein without departing from the spirit and scope of the invention as defined by the appended claims.

The invention claimed is:

1. A microminiature X-ray tube with a triode structure using a nano emitter, comprising:

an electron emitter comprising:

a cathode having fine-patterned nano emitters;

a gate disposed above the cathode to induce electron emission and focus electron beams; and a cover disposed above the gate; and an anode disposed above the electron emitter and accelerating electrons emitted from the cathode to generate an X-ray by means of electron collision, wherein the electron emitter is fixed from the cathode to the cover by a bonding material.

2. The microminiature X-ray tube according to claim 1, wherein the nano emitters are fine-patterned on the cathode through screen printing, exposure, and development.

3. The microminiature X-ray tube according to claim 1, wherein the cover has a hole larger than a field emission region of the nano emitters.

4. The microminiature X-ray tube according to claim 1, wherein a plurality of gate holes each having the same pitch as the nano emitters are formed in a macro structure in the gate, and the size of the gate holes are greater than sizes of the nano emitters.

5. The microminiature X-ray tube according to claim 4, wherein the gate holes have a minimum pitch within the size of the gate.

6. The microminiature X-ray tube according to claim 4, wherein the gate holes are arranged in an arbitrary shape.

7. The microminiature X-ray tube according to claim 4, wherein the gate holes have inclined opening structures which are inclined at a predetermined angle to allow the electron beams emitted from the nano emitters to be focused onto the anode.

8. The microminiature X-ray tube according to claim 1, wherein the bonding material is a frit glass.

9. The microminiature X-ray tube according to claim 1, wherein the gate and the cover are formed of a metal material having a thermal expansion coefficient similar to the bonding material.

10. The microminiature X-ray tube according to claim 1, wherein a spacer is interposed between the cathode and the gate to maintain a predetermined interval between the cathode and the gate.

11. The microminiature X-ray tube according to claim 1, wherein an auxiliary electrode formed of a conductive metal is disposed on a top or an inner surface of the cover to allow the electron beams focused through the gate to have a finer focal point.

12. The microminiature X-ray tube according to claim 11, wherein a width of the auxiliary electrode disposed on the top of the cover is not greater than a top width of the cover, and a thickness of the auxiliary electrode disposed on the inner surface of the cover is not greater than one half of the thickness of the cover or has a value corresponding to a thickness enough to secure an insulating property as much as possible.

13. The microminiature X-ray tube according to claim 1, wherein the electron emitter further comprises a transistor for current switching, the cathode is coupled to a source of the transistor, a pulse voltage is applied to a gate of the transistor, and a ground is coupled to a drain of the transistor.

14. The microminiature X-ray tube according to claim 13, wherein an amount of electrons emitted from the nano emitters is controlled by the cathode current, wherein the cathode current is controlled by the pulse voltage applied to the gate of the transistor.

15. The microminiature X-ray tube according to claim 1, wherein the electron emitter is mounted within a vacuum tube.

* * * * *